US009209557B2

(12) United States Patent
Kobayashi et al.

(10) Patent No.: US 9,209,557 B2
(45) Date of Patent: Dec. 8, 2015

(54) ELECTRIC CONNECTOR

(71) Applicant: IRISO ELECTRONICS CO., LTD., Kanagawa (JP)

(72) Inventors: Hiroaki Kobayashi, Kanagawa (JP); Hidehiro Shindo, Kanagawa (JP); Shigeru Mitsuzuka, Kanagawa (JP)

(73) Assignee: Iriso Electronics Co., Ltd., Kanagawa (JP)

( * ) Notice: Subject to any disclaimer, the term of this patent is extended or adjusted under 35 U.S.C. 154(b) by 0 days.

(21) Appl. No.: 14/306,874

(22) Filed: Jun. 17, 2014

(65) Prior Publication Data

US 2015/0024620 A1 Jan. 22, 2015

(30) Foreign Application Priority Data

Jul. 19, 2013 (JP) ..... 2013-150064

(51) Int. Cl.
*H01R 12/00* (2006.01)
*H01R 13/62* (2006.01)

(52) U.S. Cl.
CPC ..... *H01R 13/62* (2013.01)
USPC ..... 439/74; 439/660; 439/345

(58) Field of Classification Search
CPC ..... H01R 13/20; H01R 13/6315; H01R 12/91
USPC ..... 439/74, 660, 83, 345, 247
See application file for complete search history.

(56) References Cited

U.S. PATENT DOCUMENTS 3,289,146 A * 11/1966 Tuchel ..... 439/630
3,858,957 A 1/1975 Harwood et al.
4,087,151 A * 5/1978 Robert et al. ..... 439/637
4,106,841 A * 8/1978 Vladic ..... 439/637

(Continued)

FOREIGN PATENT DOCUMENTS

EP 2019455 A2 1/2009
JP 04-269478 A 9/1992

(Continued)

OTHER PUBLICATIONS

Notice of Reasons for Rejection from Japanese Patent App. No. 2013-150064 (Aug. 15, 2013) with certified English language translation thereof.

(Continued)

*Primary Examiner* — Briggitte R Hammond
(74) *Attorney, Agent, or Firm* — Cermak Nakajima & McGowan LLP; Tomoko Nakajima

(57) ABSTRACT

A socket terminal includes a front connection portion that comes into contact with a plug terminal, in which a recess having an inner wall is formed in a contact surface that comes into contact with the front connection portion. The front connection portion is locked on the inner wall by coming into contact with the inner wall when moving in a direction in which the plug terminal is pulled out from the socket terminal. The front connection portion also includes a contact edge that wipes impurities off the contact surface. An electrical connection between the socket terminal and the plug terminal can be maintained by locking the socket terminal on the inner wall even with an application of vibrations in directions in which the plug terminal is inserted and pulled out. Since the contact edge can remove the impurities, the electrical connection between the terminals can be stabilized.

21 Claims, 12 Drawing Sheets

(a)

(b)

(56) References Cited

U.S. PATENT DOCUMENTS

| | | | | |
|---|---|---|---|---|
| 4,209,220 | A * | 6/1980 | Szablowski | 439/862 |
| 4,514,030 | A * | 4/1985 | Triner et al. | 439/637 |
| 5,224,866 | A * | 7/1993 | Nakamura et al. | 439/81 |
| 5,885,092 | A * | 3/1999 | Ito et al. | 439/74 |
| 6,540,561 | B1 * | 4/2003 | Masumoto | 439/660 |
| 6,866,522 | B2 * | 3/2005 | Terashima et al. | 439/74 |
| 7,125,260 | B2 * | 10/2006 | Orita et al. | 439/247 |
| 7,320,606 | B2 * | 1/2008 | Midorikawa | 439/74 |
| 7,374,432 | B2 * | 5/2008 | Koguchi et al. | 439/247 |
| 7,674,115 | B2 * | 3/2010 | Midorikawa | 439/74 |
| 7,862,345 | B2 * | 1/2011 | Fukazawa et al. | 439/74 |
| 8,758,029 | B2 * | 6/2014 | Midorikawa | 439/74 |
| 8,840,406 | B2 * | 9/2014 | Hirata | 439/74 |
| 2007/0141867 | A1 * | 6/2007 | Kishi et al. | 439/74 |

FOREIGN PATENT DOCUMENTS

| | | | |
|---|---|---|---|
| JP | 3117439 | B1 | 10/2000 |
| JP | 2007-035291 | A | 2/2007 |
| JP | 2011-249076 | A | 12/2011 |
| JP | 2012-221592 | A | 11/2012 |

OTHER PUBLICATIONS

Notice of Reasons for Rejection from Japanese Patent App. No. 2013-150064 (Nov. 7, 2013) with certified English language translation thereof.

European Search Report for European Patent App. No. 14183187.5 (Dec. 2, 2014).

European Search Report for European Patent App. No. 14173381.6 (Oct. 21, 2014).

* cited by examiner (a)

(b)

(a)

(b)

(a)

(b)

(a)

(b)

(a)

(b)

(a)

(b)

(a)

(b)

(a)

(b)

(a)

(b)

ELECTRIC CONNECTOR

BACKGROUND OF THE INVENTION

1. Field of the Invention

The present invention relates to an electric connector that electrically connects circuit boards to each other.

2. Description of the Related Art

A floating connector that includes a plug and a socket and that can correct displacement between the plug and the socket relative to each other is known to date as an electric connector that maintains a connection between circuit boards regardless of an application of vibrations. Examples of electric connectors that have been developed to, particularly, highly reliably connect terminals to each other include an electric connector in which an S-shaped movable portion is provided on a socket terminal so that the socket is movable relative to the plug (Japanese Unexamined Patent Application Publication No. 2011-249076). Such an electric connector can maintain the plug and the socket in a correct fitting state due to the movable portion of the socket terminal absorbing vibrations that would occur when either the substrate on which the plug is mounted or the substrate on which the socket is mounted is displaced.

Some electric connectors, such as an electric connector used as a component of an automobile or a precision machine, are used in an environment subject to large impacts or vibrations. Although an electric connector used in such an environment can maintain the plug and the socket in a correct fitting state at the beginning, it may fail to maintain stable electrical connection due to an insufficient contact between the terminals upon receipt of an impact or vibrations during use. Examples of causes that make an electrical connection between the terminals unstable include impurities such as substrate residues or dust adhering to the plug terminal. A countermeasure for such impurities is essential to establish a highly reliable connection between terminals.

SUMMARY OF THE INVENTION

The present invention was made to solve the above problems. Specifically, the present invention aims to provide an electric connector that can reliably maintain a connection between terminals even when the plug and the socket receive an impact or vibrations while being in a fitted state. The present invention also aims to provide an electric connector that can reliably maintain a connection between terminals even when impurities adhere to the plug terminal.

In order to achieve the above-described object, an aspect of the present invention has the following structure.

Specifically, an aspect of the invention provides an electric connector including a plug including a plug terminal and a socket including a socket terminal, the plug terminal and the socket terminal coming into contact with each other and being electrically connected to each other when the plug and the socket are fitted together, wherein the socket terminal includes a connection portion that comes into contact with the plug terminal, and wherein the plug terminal includes a locking portion on a contact surface that comes into contact with the connection portion of the socket terminal, the connection portion being locked on the locking portion by coming into contact with the locking portion when moving in a direction in which the plug terminal is pulled out from the socket terminal.

The socket terminal includes a connection portion that comes into contact with the plug terminal. The plug terminal includes a locking portion on a contact surface that comes into contact with the connection portion of the socket terminal, the connection portion being locked on the locking portion by coming into contact with the locking portion when moving in a direction in which the plug terminal is pulled out from the socket terminal. Thus, even when an impact or vibrations is/are applied to the electric connector, the state where the connection portion and the contact surface are in contact with each other can be maintained by preventing the plug from being pulled out from the socket with a force that is weaker than or equal to a predetermined pulling force. Thus, the electrical connection between the plug terminal and the socket terminal can be maintained.

In an aspect of the present invention, a recess, at which a plate surface of the plug terminal is recessed, can be formed in the contact surface of the plug terminal as the locking portion. The socket terminal and the plug terminal can be locked together as a result of the connection portion of the socket terminal entering the recess while the plug and the socket are fitted together.

When the terminals are locked together as a result of the connection portion entering the recess, the inner walls of the recess can restrict the movement of the connection portion. In addition, an electrical connection between the plug terminal and the connection portion can be established as a result of the connection portion coming into contact with the inner walls of the recess. Moreover, an operator can receive a tactile "click" response when the connection portion enters the recess while the plug and the socket are being fitted together and thus can manually perceive the progress on the fitting of the socket and the plug.

In an aspect of the present invention, a through hole, which passes through the thickness of the plug terminal, can be formed in the contact surface of the plug terminal as the locking portion, and the socket terminal and the plug terminal can be locked together as a result of the connection portion of the socket terminal entering the through hole while the plug and the socket are fitted together.

Unlike the recess, the through hole does not have an electric bottom of the terminal. Thus, by forming the through hole in the contact surface of the plug terminal that serves as a locking portion, the connection portion is allowed to deeply enter the through hole, so that the terminals can be locked together.

In an aspect of the present invention, a protrusion, which protrudes from the contact surface of the plug terminal, can be disposed on the contact surface of the plug terminal as the locking portion, and the socket terminal and the plug terminal can be locked together when the plug terminal moves in the direction in which the plug terminal is pulled out while the plug and the socket are fitted together as a result of the connection portion of the socket terminal crossing the protrusion of the plug terminal.

The connection portion of the socket terminal can be reliably fitted to the plug terminal as a result of the connection portion locking on the protrusion, which is disposed on the contact surface of the plug terminal as a locking portion, at a position across the protrusion.

In an aspect of the present invention, a movable-range gap that allows displacement in directions in which the plug terminal is inserted into and pulled out from the socket terminal while the plug and the socket are fitted together is provided between the connection portion of the socket terminal and the locking portion of the plug terminal so that the plug and the socket are displaceable relative to each other in the directions in which the plug terminal is inserted into and pulled out from the socket terminal while the plug and the socket are fitted together.

Thus, the displacement of the plug in the directions in which the plug is inserted and pulled out can be absorbed by moving the connection portion within the movable-range gap even when an impact or vibrations is/are applied to the plug in the directions in which the plug is inserted and pulled out.

In an aspect of the present invention, the connection portion of the socket terminal can include a contact edge that wipes away an impurity that adheres to the contact surface of the plug terminal by sliding over the contact surface, and the contact surface of the plug terminal includes an impurity remover that scrapes the impurity off the contact edge of the socket terminal that has wiped away the impurity as a result of the contact edge sliding over the impurity remover.

The impurities adhering to the contact surface of the plug terminal that have been wiped away as a result of the contact edge sliding over the contact surface include not only dust simply adhering to the surface but also impurities stuck fast to the contact surface such as substrate residues. Providing the impurity remover, which scrapes impurities off the contact edge, on the contact surface of the plug terminal enables reliable removal of the impurities adhering to the surface of the contact edge from the contact edge, thereby establishing a stable electrical connection between the connection portion and the contact surface.

In an aspect of the present invention, a recess can be formed in the contact surface of the plug terminal and an opening edge of the recess can serve as the impurity remover.

Using the opening edge of the recess as an impurity remover allows the impurities at the contact edge to be scraped off as a result of the contact edge sliding over the opening edge of the recess from the state where the connection portion is in the recess. Moreover, since the removed impurities can be housed in the recess, the impurities scraped off the contact edge can be prevented from adhering to the contact surface again.

In an aspect of the present invention, a through hole can be formed in the contact surface of the plug terminal and an opening edge of the through hole can serve as the impurity remover.

By providing the through hole in the contact surface, the connection portion can be more deeply inserted into the through hole. Thus, the impurities can be reliably scraped off as a result of the contact edge coming into contact with the opening edge.

In an aspect of the present invention, a protrusion can be formed on the contact surface of the plug terminal and a step surface of the protrusion can serve as the impurity remover.

By using the step surface of the protrusion as an impurity remover, the impurities adhering to the contact edge can be reliably scraped off by causing the contact edge to slide over the step surface.

In an aspect of the present invention, the contact surface of the plug terminal has side locking surfaces that restrict sideways displacement of the connection portion of the socket terminal in a width direction of the plug terminal.

Providing such side locking surfaces enables restriction of displacement of the connection portion in the width direction even when an impact or vibrations is/are applied in the width direction of the plug terminal while the plug and the socket are fitted together.

In an aspect of the present invention, the side locking surfaces can be recessed so as to face each other in the width direction of the plug terminal.

In this structure, the connection portion can be enclosed by multiple side locking surfaces, whereby the movement of the connection portion can be restricted to the range enclosed by the side locking surfaces.

In an aspect of the present invention, the side locking surfaces can be formed as inner surfaces of a recess or a through hole serving as the locking portion.

In this structure, the connection portion can be inserted into the recess or the through hole and the displacement of the connection portion can be restricted to the range enclosed by the inner surfaces of the recess or the through hole.

In an aspect of the present invention, the contact surface of the plug terminal can include inclined surfaces that position the connection portion of the socket terminal by causing the connection portion to slide over the inclined surfaces in the width direction of the plug terminal.

In this structure, the connection portion can be guided to the normal contact position by being caused to slide over the inclined surfaces even when the connection portion is almost displaced from the normal contact position, at which the connection portion is normally in contact with the contact surface, in the width direction of the plug terminal upon receipt of an impact or vibrations.

In an aspect of the present invention, the contact surface of the plug terminal can include inclined surfaces that position the connection portion of the socket terminal by causing the connection portion to slide over the inclined surfaces in at least one of a direction in which the plug terminal is inserted and a direction in which the plug terminal is pulled out.

By providing such inclined surfaces, the connection portion can be guided to the normal contact position by being caused to slide over the inclined surfaces even when the connection portion is almost displaced from the normal contact position in the directions in which the plug terminal is inserted and pulled out upon receipt of an impact or vibrations.

In an aspect of the present invention, the inclined surfaces can be recessed so as to face each other.

When the connection portion is disposed between the opposing inclined surfaces so as to be enclosed by the inclined surfaces while the plug and the socket are fitted together, the connection portion can be returned to the normal contact position by being guided by the inclined surfaces even after the connection portion is moved toward the inclined surfaces from the normal contact position.

In an aspect of the invention, the inclined surfaces can be formed as inner surfaces of a recess or a through hole serving as the locking portion.

In this structure, the inner surfaces of the recess or the through hole can have a guide function that allows the connection portion to slide into the recess or the through hole.

In an aspect of the invention, the socket terminal can include a contact portion, which includes the connection portion, and an elastic portion, which elastically supports the contact portion, and the contact portion can include a front connection portion and a rear connection portion, the front connection portion being used as the connection portion that slides over the plug terminal first and wipes away an impurity that adheres to the contact surface of the plug terminal while the plug and the socket are being fitted together, the rear connection portion coming into contact with the wiped contact surface of the plug terminal subsequent to the front connection portion.

If one connection portion is used to wipe away impurities and to establish an electrical connection with the contact surface, the impurities may adhere to the connection portion and the electrical connection with the contact surface may become unstable. In contrast, such an inconvenience can be avoided by separately providing, to the socket terminal, a front connection portion, which wipes away the impurities adhering to the contact surface of the plug terminal, and a rear connection portion, which comes into contact with the wiped contact surface of the plug terminal. Moreover, the adhesion of the impurities to the rear terminal can be avoided as a result of the rear connection portion coming into contact with a portion of the contact surface from which the impurities have been wiped away by the front connection portion.

In an aspect of the invention, the socket terminal includes a front terminal that includes a contact portion and an elastic portion, the contact portion including the connection portion, the elastic portion elastically supporting the contact portion; and a rear terminal that includes a contact portion and an elastic portion, the contact portion being electrically connected to the plug terminal, the elastic portion elastically supporting the contact portion.

When the elastic portion that elastically supports the connection portion and the elastic portion that elastically supports the contact portion electrically connected with the plug terminal are separately provided, the contact portion including the connection portion and the contact portion electrically connected with the plug terminal can be moved independently of each other. Thus, the connection portion and the contact portion can be brought into contact with the contact surface without being affected by each other in terms of the contact pressure.

In an aspect of the invention, the socket terminal includes a substrate connection portion that is to be fixed to a circuit board, a movable connection portion including a connection portion, and a movable portion that elastically supports the substrate connection portion and the movable connection portion so that the substrate connection portion and the movable connection portion are displaceable relative to each other.

In this structure, the movable portion can absorb the displacement even when an impact or vibrations is/are applied to the electric connector or the circuit boards. Thus, by making the movable connection portion displaceable relative to the substrate connection portion, an electrical connection between the socket terminal and the plug terminal can be maintained by displacing, for example, the movable connection portion in a direction away from the plug terminal.

In an aspect of the invention, the socket can include a fixed housing that is to be fixed to a circuit board and a movable housing that is to be fitted to a housing of the plug and the socket terminal can elastically support the fixed housing and the movable housing so that the fixed housing and the movable housing are displaceable relative to each other.

When the socket includes the fixed housing and the movable housing and the socket terminal elastically supports these housings so that these housings are displaceable relative to each other, an embodiment of the present invention can be made as a floating connector that has the above-described operations and effects and that establishes a highly reliable connection.

According to the present invention, an electrical connection between the socket terminal and the plug terminal can be maintained by locking the socket terminal on the locking portion even with an application of an impact or vibrations. Moreover, the electrical connection between the plug terminal and the socket terminal can be stabilized by removing impurities adhering to the plug terminal. In this manner, the plug terminal and the socket terminal can be highly reliably connected together.

BRIEF DESCRIPTION OF THE DRAWINGS

FIG. 3A is a perspective view of the recess and FIG. 3B is a front view of the recess.

FIG. 4A illustrates the state before locking and FIG. 4B illustrates the state after locking.

FIG. 5A illustrates the state where the front connection portion wipes away impurities and FIG. 5B illustrates the state where the front connection portion finishes removing the impurities.

FIG. 7A is a perspective view of a through hole and FIG. 7B is a cross-sectional view of the through hole.

FIG. 8A is a perspective view of the protrusion and FIG. 8B is a cross-sectional view of the protrusion.

FIG. 9A is a perspective view of the recess and FIG. 9B is a cross-sectional view of the recess.

FIG. 10A is a perspective view of the recess and FIG. 10B is a cross-sectional view of the recess.

FIG. 10A is a perspective view of the recess and FIG. 10B is a cross-sectional view of the recess.

FIG. 10A is a perspective view of the recesses and FIG. 10B is a cross-sectional view of the recesses.

DESCRIPTION OF THE PREFERRED EMBODIMENTS

Figure 1:
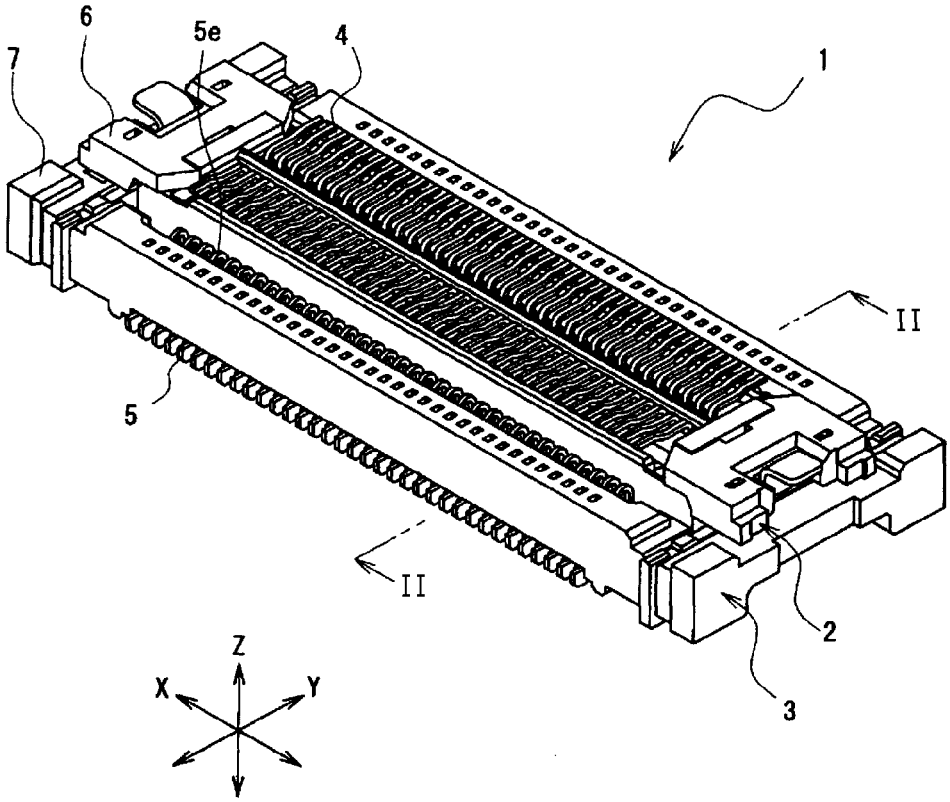
FIG. 1 is a perspective view of a floating connector according to a first embodiment.

Referring now to the drawings, embodiments of the present invention will be described below. Components that are common across the embodiments described below are denoted by the same reference symbols and are not redundantly described.

First Embodiment

FIG. 1 to FIG. 5B

Figure 2:
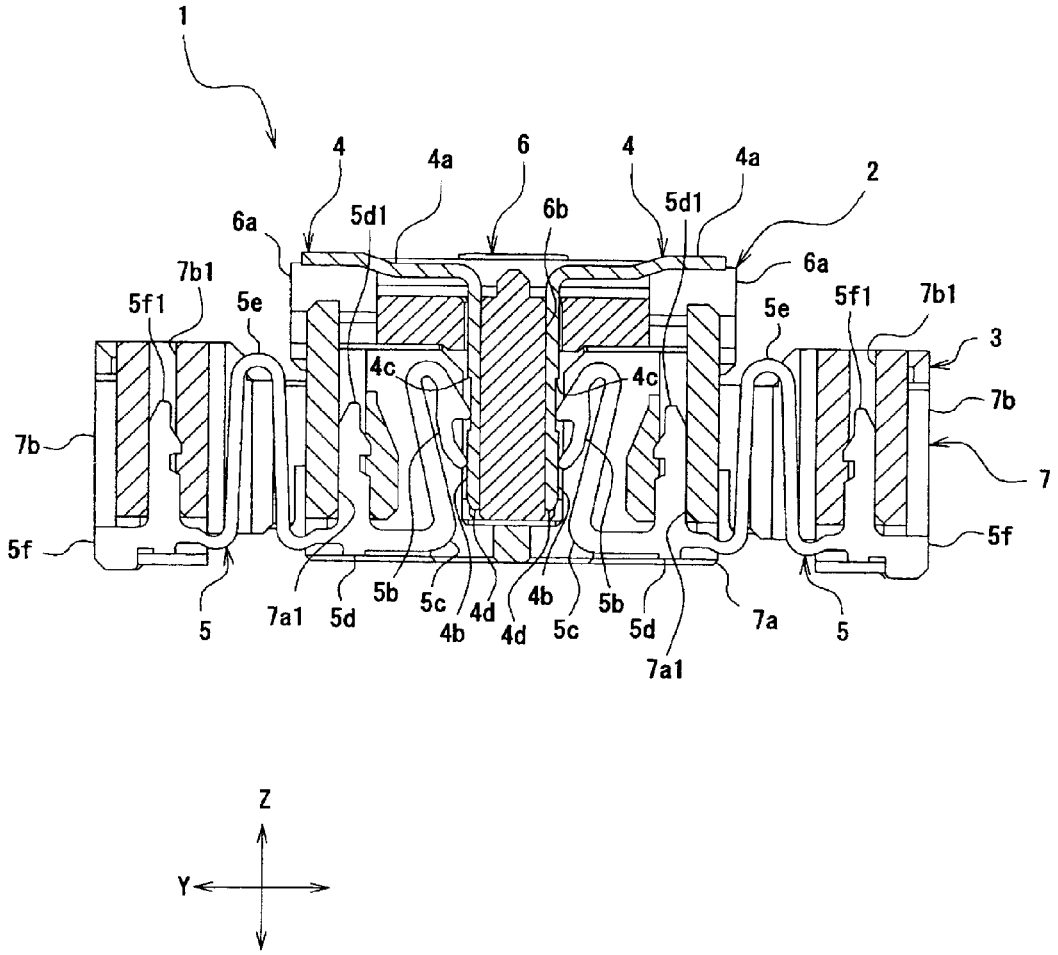
FIG. 2 is a cross-sectional view of the floating connector taken along the line II-II of FIG. 1.
Figure 3:
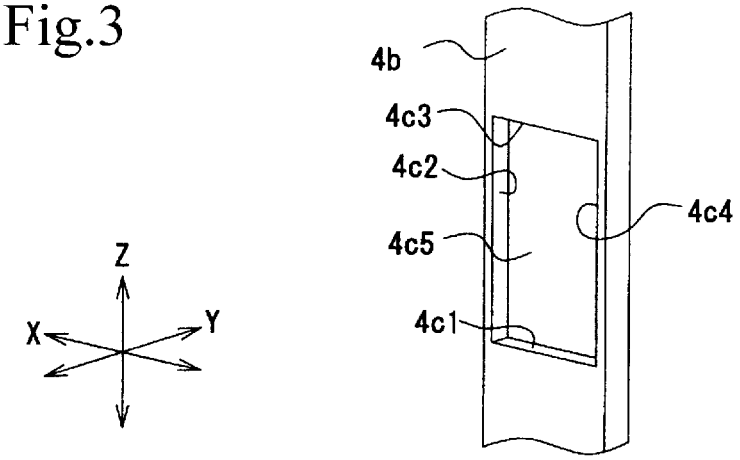
FIGS. 3A and 3B illustrate a recess, where
Figure 3:
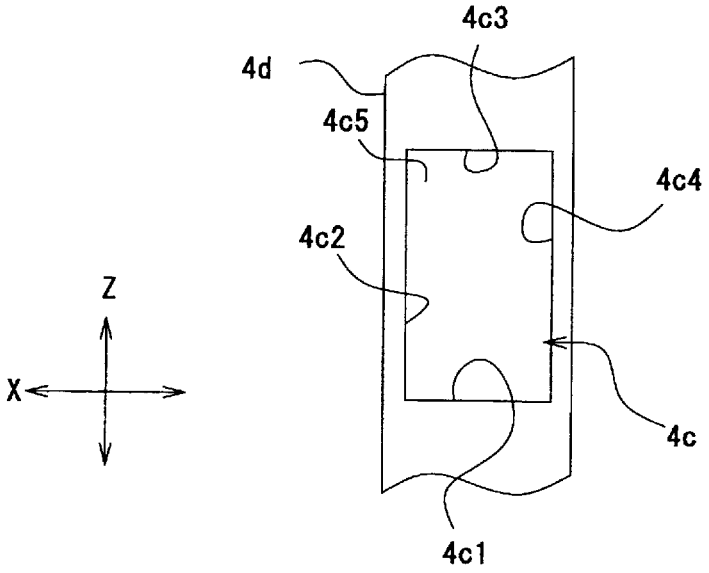
Figure 4:
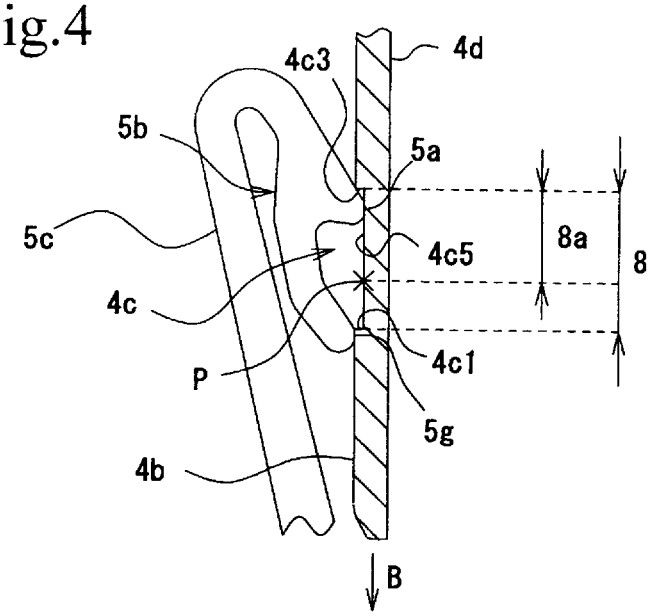
FIGS. 4A and 4B are cross-sectional views of a socket terminal and a plug terminal illustrating the way in which the socket terminal and the plug terminal are locked together, where
Figure 4:
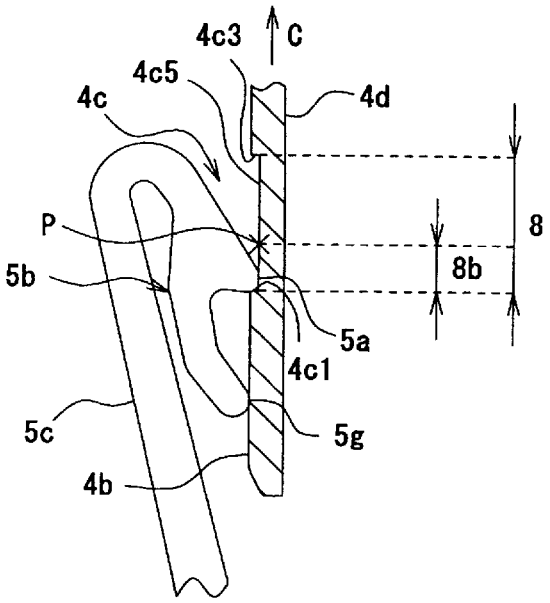

As illustrated in FIGS. 1 and 2, a floating connector 1, which is an example of "an electric connector" of the present invention, includes a plug 2 and a socket 3. The plug 2 includes plug terminals 4 and the socket 3 includes socket terminals 5.

Plug

The plug 2 includes a plug housing 6 and multiple plug terminals 4 attached to the plug housing 6. The plug housing 6 has a substantially T-shaped cross section. The plug housing 6 includes a substantially rectangular-parallelepiped terminal holding portion 6*a* that extends parallel to a circuit board (not illustrated) and a plug body 6*b* that extends toward the socket 3 from the center position in the cross direction of the terminal holding portion 6*a*. The plug housing 6 is made of an insulating resin.

Plug Terminal

The plug terminals 4 have a substantially L-shaped cross section. The plug terminals 4 are attached to the plug housing 6 while being divided into two groups and disposed on both sides of the plug body 6*b*. The plug terminals 4 are attached to the plug body 6*b* and the terminal holding portion 6*a* at regular intervals in the longitudinal direction of the plug 2.

Each plug terminals 4 includes a substrate connection portion 4*a* at which the plug terminal 4 is fixed to the circuit board and a contact portion 4*d* disposed along the plug body 6*b*.

The contact portion 4*d* has a contact surface 4*b* on a side facing the socket terminals 5. The contact surface 4*b* is electrically connected to the corresponding socket terminal 5. The contact surface 4*b* is a surface of a flat board having a width in the direction in which the plug terminals 4 are arranged. A recess 4*c* having an angular-c-shaped cross section is formed in the contact surface 4*b*.

In the following description, the longitudinal direction of the floating connector 1 is described as an X direction (in the direction of arrows X in each drawing), the cross direction of the floating connector 1 is described as a Y direction (in the direction of arrows Y in each drawing), and the direction in which the plug 2 is inserted into and pulled out from the socket 3 is described as a Z direction (in the direction of arrows Z in each drawing).

Recess

As illustrated in FIGS. 2 to 4B, the recess 4*c* is formed around the center of the contact surface 4*b* in the Z direction and defined by inner walls 4*c*1 to 4*c*4 and a back wall 4*c*5. The inner walls 4*c*1 to 4*c*4 are disposed perpendicularly to the surface of the contact portion 4*d*. The inner walls 4*c*1 and 4*c*3 have flat surfaces extending in the X direction and the inner walls 4*c*2 and 4*c*4 have flat surfaces extending in the Z direction. The inner wall 4*c*1 disposed on the side closer to the socket 3 in the Z direction serves as a "locking portion". As described below, when the plug 2 is to be pulled out from the socket 3, the front connection portion 5*a* of the socket terminal 5 comes into contact with the inner wall 4*c*1 and is locked on the inner wall 4*c*1.

Figure 5:
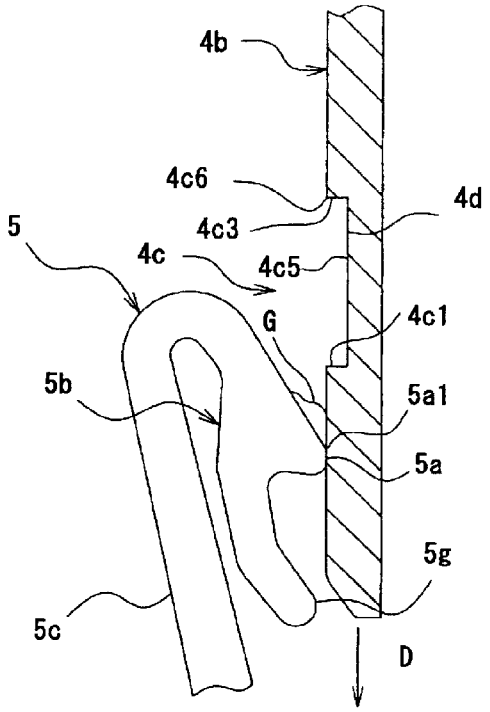
FIGS. 5A and 5B are cross-sectional views of a socket terminal and a plug terminal illustrating the way in which a front connection portion removes impurities, where
Figure 5:
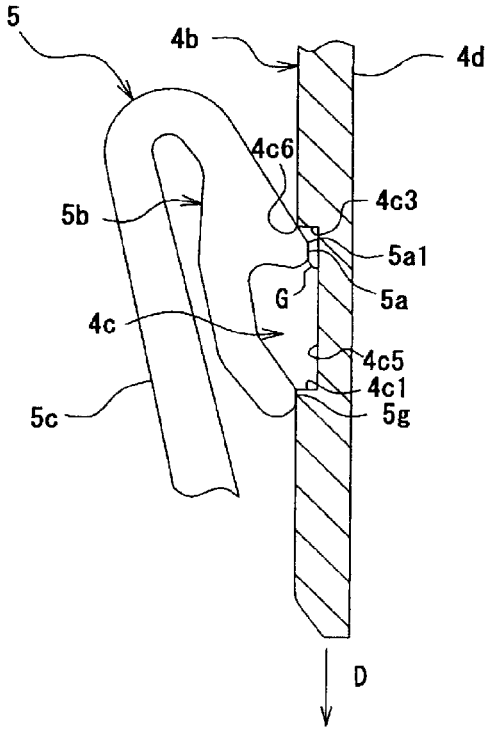

As illustrated in FIGS. 5A and 5B, an opening edge 4*c*6 of the inner wall 4*c*3 that faces the inner wall 4*c*1 serves as an "impurity remover". The opening edge 4*c*6 can scrape impurities G on the contact surface 4*b* that have been wiped by a front connection portion 5*a* off the front connection portion 5*a*. The front connection portion 5*a* will be described below.

As illustrated in FIGS. 3A and 3B, among the inner walls 4*c*1 to 4*c*4 that define the recess 4, the inner walls 4*c*2 and 4*c*4 perpendicular to the inner walls 4*c*1 and 4*c*3 are parallel to each other and function as "side locking surfaces". When the socket terminal 5 receives vibrations in the X direction while the front connection portion 5*a* is inserted in the recess 4*c*, the front connection portion 5*a* comes into contact with the inner walls 4*c*2 and 4*c*4 and is locked on the inner walls 4*c*2 and 4*c*4. In this manner, the front connection portion 5*a* can be prevented from being displaced in the X direction.

In the floating connector 1, a movable housing 7*a* is displaceable relative to fixed housings 7*b*. Thus, the socket terminals 5 and the plug terminals 4 are more likely to rub against one another. When the front connection portions 5*a* and the rear connection portions 5*g* rub against the contact surface 4*b*, the plating on the surfaces of the terminals may be removed. However, the inner walls 4*c*1 and 4*c*3 prevent each front connection portion 5*a* from being displaced in the Z direction relative to the corresponding plug terminal 4 and the inner walls 4*c*2 and 4*c*4 similarly prevent each front connection portion 5*a* from being displaced in the X direction relative to the corresponding plug terminal 4. Thus, removal of the plating on the contact surface 4*b* and the front terminals 5*a* due to slight sliding movement of the floating connector 1 can be prevented.

As a result of preventing the front connection portion 5*a* from being displaced, the entirety of each socket terminal 5 is prevented from being displaced, whereby the rear connection portion 5*g* is prevented from being displaced. The rear connection portions 5*g* and the contact surface 4*b* can be prevented from rubbing against each other, whereby removal of the plating of the rear connection portions 5*g* and the contact surface 4*b* can be prevented.

Socket

The socket 3 includes a socket housing 7 and socket terminals 5. The socket housing 7 includes a substantially rectangular-parallelepiped movable housing 7*a* and a pair of fixed housings 7*b* that are disposed in the longitudinal direction of the movable housing 7*a* so as to sandwich the movable housing 7*a*. The socket housing 7 is made of an insulating resin. The movable housing 7*a* has fixing holes 7*a*1 and the fixed housings 7*b* each have fixing holes 7*b*1. The fixing holes 7*a*1 and 7*b*1 are provided for fixing the socket terminals 5 to the socket housing 7.

Socket Terminal

As illustrated in FIG. 2, each socket terminal 5 includes a contact portion 5*b*, a substantially S-shaped elastic portion 5*c*, a base portion 5*d* adjacent to the elastic portion 5*c*, an inverted-U-shaped movable portion 5*e*, and a substrate connection portion 5*f* that is connected to a circuit board. The base portion 5*d* has a fixed-to-housing piece 5*d*1 that is fixed to the movable housing 7*a* and the substrate connection portion 5*f* has a fixed-to-housing piece 5*f*1 that is fixed to the corresponding fixed housing 7*b*.

The socket terminals 5 are arranged while being divided into two groups so as to face each other and extend in the longitudinal direction of the socket housing 7. The socket terminals 5 are formed by punching a flat metal sheet into terminals and thus are flat shaped without being bent in the thickness direction. Thus, more terminals can be arranged at a narrower pitch than in the case of terminals bent in the thickness direction. Each socket terminal 5 has a contact portion 5*b* at the tip portion. The contact portion 5*b* has a front connection portion 5*a* and a rear connection portion 5*g* that protrude toward the contact surface 4*b*. The elastic portion 5*c* elastically supports the contact portion 5*b* so as to allow the front connection portion 5*a* and the rear connection portion 5*g* to come into contact with the contact surface 4*b*. When the rear connection portion 5*g* comes into contact with the contact surface 4*b*, an electrical connection between the socket terminal 5 and the plug terminal 4 is established.

The contact portion 5*b*, the elastic portion 5*c*, and the base portion 5*d* disposed on a first end side of the socket terminal 5 are housed in the movable housing 7*a* and are fixed to the movable housing 7*a* by pressure-inserting the fixed-to-housing piece 5*d*1 into the fixing hole 7*a*1 of the movable housing 7*a*. A second end side of the socket terminal 5 is fixed to the corresponding fixed housing 7*b* by pressure-inserting the fixed-to-housing piece 5*f*1 of the substrate connection portion 5*f* into the fixing hole 7*b*1.

A movable portion 5*e* shaped like a spring is disposed between the movable housing 7*a* and each fixed housing 7*b*. Even when the floating connector 1 receives vibrations, the movable portion 5*e* allows the movable housing 7*a* to be displaced relative to the fixed housing 7*b*. Displacement of the socket terminal 5 relative to the corresponding plug terminal 4 due to vibrations being applied to the floating connector 1 is absorbed by the movable portion 5*e*. Thus, the electrical connection between the socket terminals 5 and the plug terminals 4 can be easily maintained.

Method for Locking Socket Terminal on Plug Terminal

The front connection portion 5*a* and the rear connection portion 5*g* are provided in order from the leading end side at the end of each contact portion 5*b*. Firstly, when the plug 2 is inserted into the socket 3, the front connection portions 5*a* and the rear connection portions 5*g* come into contact with the contact surface 4*b* in this order. When the plug 2 is inserted into the socket 3 further, each recess 4*c* is moved to the corresponding front connection portion 5*a* as illustrated in FIG. 4A and the front connection portion 5*a* enters the recess 4*c*. Thus, the socket 3 and the plug 2 are fitted together. While the socket 3 and the plug 2 are fitted together, the rear connection portions 5*g* come into contact with the contact surfaces 4*b* and thus the electrical connection between the plug terminals 4 and the socket terminals 5 is established.

An operator (not illustrated) can receive a tactile "click" response when the front connection portions 5*a* enter the recesses 4*c* and thus can manually perceive the progress on the fitting of the socket 3 and the plug 2.

When large vibrations are applied in the direction in which the plug 2 is pulled out (in the direction of arrow C in FIG. 4B) while the plug 2 and the socket 3 are fitted together, each front connection portions 5*a* is moved in the direction opposite to the direction of arrow C as illustrated in FIG. 4B. The front connection portion 5*a* then comes into contact with the corresponding inner wall 4*c*1 and is locked on the inner wall 4*c*1.

Here, the shape of each front connection portion 5*a* or each recess 4*c*1 may be changed in accordance with the removability of the plug 2 that has been set in advance to such a degree with which the front connection portion 5*a* can cross the corresponding inner wall 4*c*1. For example, each front connection portion 5*a* may be shortened in the Y direction so as not to be inserted into the corresponding recess 4*c* to an excessively deep point or the front connection portion 5*a* may have a rounded tip so as to be capable of easily crossing the corresponding inner wall 4*c*1. Similarly, shallowing each recess 4*c* by shortening the corresponding inner walls 4*c*1 to 4*c*4 in the Y direction allows the corresponding front connection portion 5*a* to easily cross the inner wall 4*c*1. In these manners, the operation of removing the plug 2 from the socket 3 can be facilitated.

On the other hand, each front connection portion 5*a* may be lengthened in the Y direction so as to be deeply inserted into the corresponding recess 4*c* or the front connection portion 5*a* may have a tapered end so that the front connection portion 5*a* becomes unlikely to cross the inner wall 4*c*1. Alternatively, deepening each recess 4*c* by lengthening the inner walls 4*c*1 to 4*c*4 in the Y direction allows the corresponding front connection portion 5*a* to be deeply inserted into the recess 4*c* so that the front connection portion becomes unlikely to cross the inner wall 4*c*1.

Floating Function in Z Direction

Typical electric connectors with the floating structure allow displacement in the X direction and the Y direction. In the floating connector 1 according to this embodiment, however, the movable portions 5*e* allows the movable housing 7*a* to be displaced relative to the fixed housings 7*b* not only in the X direction and the Y direction but also in the Z direction. Specifically, the floating connector 1 according to this embodiment of the present invention has a movable-range gap 8 between the opposing inner walls 4*c*1 and 4*c*3 of each recess 4*c* so that the corresponding front connection portion 5*a* can move in the Z direction while being inserted into the recess 4*c*. This structure thus enables complex displacement in the X, Y, and Z directions.

Here, displacement in the Z direction is specifically described.

In the floating connector 1 according to this embodiment, each front connection portion 5*a* is in contact with the corresponding back wall 4*c*5 at a normal contact position P when the socket 3 is fitted to the plug 2 in a predetermined normal fitting position. For example, when large vibrations are applied to the floating connector 1 in the direction in which the plug 2 is inserted (in the direction of arrow B of FIG. 4A), each front connection portion 5*a* can move in the corresponding movable-range gap 8 by a range 8*a* between the normal contact position P and the inner wall 4*c*3.

On the other hand, when large vibrations are applied to the floating connector 1 in the direction in which the plug 2 is pulled out (in the direction of arrow C of FIG. 4B), each front connection portion 5*a* can move in the corresponding movable-range gap 8 by a range 8*b* between the normal contact position P and the inner wall 4*c*1. In this case, the front connection portion 5*a* comes into contact with the inner wall 4*c*1 and is locked on the inner wall 4*c*1. Thus, the front connection portion 5*a* can be displaced in the Z direction while the electrical connection between the plug terminal 4 and the socket terminal 5 is maintained.

Method for Removing Impurities from Plug Terminal

Impurities G such as substrate residues or dust adhere to the contact surface 4*b* in some cases. If a rear connection portions 5*g* comes into contact with the contact surface 4*b* to which impurities G adhere, the impurities G may be jammed between the rear connection portion 5*g* and the contact surface 4*b*, thereby possibly making the electrical connection between the socket terminal 5 and the plug terminal 4 unstable. However, since each front connection portion 5*a* is provided in front of the corresponding rear connection portion 5*g*, as illustrated in FIG. 5A, the impurities G can be wiped away from the contact surface 4*b* by causing a contact edge 5*a*1, at which the front connection portion 5*a* comes into contact with the contact surface 4*b*, to slide over the contact surface 4*b* when the plug 2 is inserted into the socket 3 in the direction of arrow D. Thus, as illustrated in FIG. 5B, the rear connection portion 5*g* comes into contact with a portion on the contact surface 4*b* over which the front connection portion 5*a* has passed and from which the impurities G have been removed, so that the socket terminal 5 and the plug terminal 4 can be electrically connected to each other in a stable manner.

When the plug 2 is deeply inserted into the socket 3, each front connection portion 5*a* enters the corresponding recess 4*c* and then the contact edge 5*a*1 comes into contact with the opening edge 4*c*6 of the inner wall 4*c*3 of the recess 4*c*. Then, the contact edge 5*a*1 in this state rubs against the opening edge 4*c*6, whereby the impurities G that have been removed from the contact surface 4*b* and that adhere to the contact edge 5*a*1 are rubbed off. The impurities G rubbed off the contact edge 5*a*1 in this manner are housed in the recess 4*c* and can thus be prevented from adhering to the contact surface 4*b* again.

In this floating connector 1, by inserting each front connection portion 5*a* into the corresponding recess 4*c* used as a "locking portion", the plug 2 can be prevented from being pulled out from the socket 3, whereby the electrical connection between the plug terminal 4 and the socket terminal 5 can be maintained. In addition, since the contact edge 5*a*1 of the front connection portion 5*a* wipes the impurities G away and the rear connection portion 5*g* comes into contact with a portion of the contact surface 4*b* from which the impurities G have been removed, a highly reliable connection can be established.

In each socket terminal 5 of the floating connector 1, the front connection portion 5*a* and the rear connection portion 5*g* are provided at the same contact portion 5*b*. Thus, compared to the case where the front connection portion 5*a* and the rear connection portion 5*g* are provided at different contact portions 5*b*, the plug terminal 4 is more easily insertable into the socket terminal 5. Specifically, when the front connection portion 5*a* firstly comes into contact with the contact surface 4*b*, the contact portion 5*b* and the elastic portion 5*c* are pressed by the contact surface 4*b* and displaced in a direction away from the contact surface 4*b*. Then, in this state, the plug 2 can be smoothly inserted into the socket 3. Thus, the floating connector 1 can have high insertability while including a large number of plug terminals 4 and socket terminals 5.

Second Embodiment

FIG. 6

As described above as an example, each socket terminal 5 according to the first embodiment includes a front connection portion 5*a* and a rear connection portion 5*g* disposed on one substantially S-shaped elastic portion 5*c*.

Figure 6:
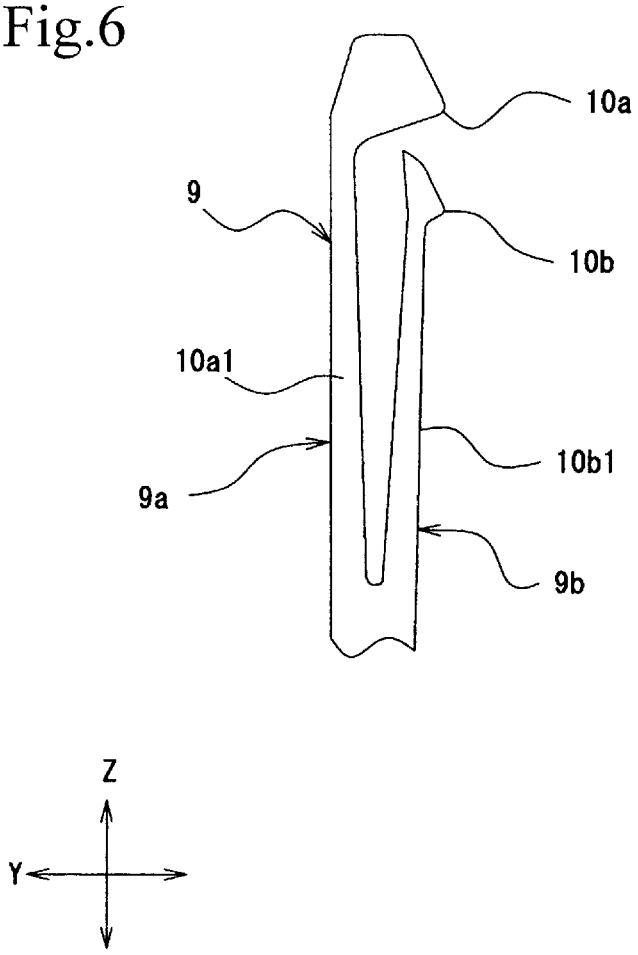
FIG. 6 illustrates a socket terminal according to a second embodiment.

As illustrated in FIG. 6, however, another example of a socket terminal may be a socket terminal 9 that includes a front terminal 9*a*, which includes a front connection portion 10*a* and an elastic portion 10*a*1, and a rear terminal 9*b*, which includes a rear connection portion 10*b* and an elastic portion 10*b*1. In this case, the rear connection portion 10*b* and the front connection portion 10*a* are aligned in the Z direction in such a manner that the front connection portion 10*a* is disposed closer to the plug 2 than the rear connection portion 10*b* in the Z direction. This structure allows the front connection portion 10*a* to come into contact with the contact surface 4*b* before the rear connection portion 10*b* when the plug 2 is inserted into the socket 3.

In the socket terminal 9, the front connection portion 10*a* and the rear connection portion 10*b* are respectively provided to different elastic portions 10*a*1 and 10*b*1 and thus can be displaced independently of each other. The rear connection portion 10*b* is thus negligibly displaced as a result of displacement of the front connection portion 10*a* in a direction away from the contact surface 4*b* when the front connection portion 10*a* is brought into contact with the contact surface 4*b* and then pressed against the contact surface 4*b*. This structure can thus prevent undesired situation such as an unstable electrical connection due to a reduction of the contact pressure of the rear connection portion 10*b* against the contact surface 4*b*. Moreover, the front connection portion 10*a* is negligibly displaced as a result of displacement of the rear connection portion 10*b* in a direction away from the contact surface 4*b* when the plug 2 is inserted into the socket 3 and the rear connection portion 10*b* comes into contact with the contact surface 4*b*. This structure can thus prevent an undesired situation such as insufficient removal of impurities G by wiping due to a reduction of the contact pressure of the front terminal 9*a* against the contact surface 4*b*.

Third Embodiment

FIG. 7A

Some embodiments describe each recess 4*c* formed in the contact surface 4*b* as a "locking portion". Here, the inner wall 4*c*1 of each recess 4*c* serves as a "locking portion" on which the corresponding front connection portion 5*a* is locked and the opening edge 4*c*6 of the inner wall 4*c*3 serves as an "impurity remover" to scrape off impurities G that have adhered to the contact edge 5*a*1. The scraped impurities G can be housed in the recess 4*c*.

Figure 7:
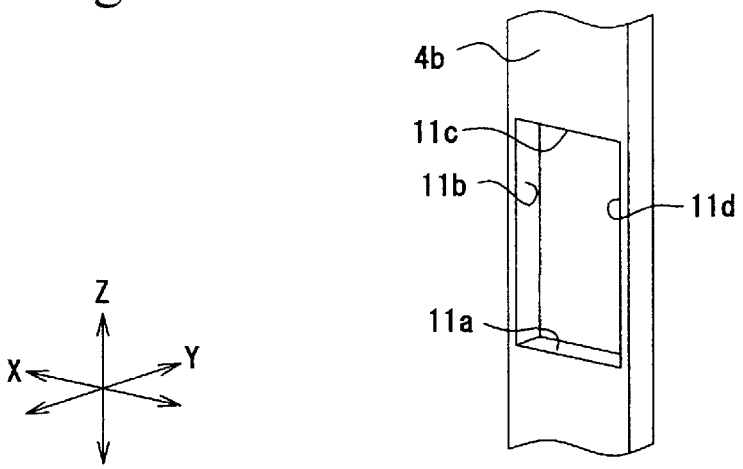
FIGS. 7A and 7B illustrate a locking portion according to a third embodiment, where
Figure 7:
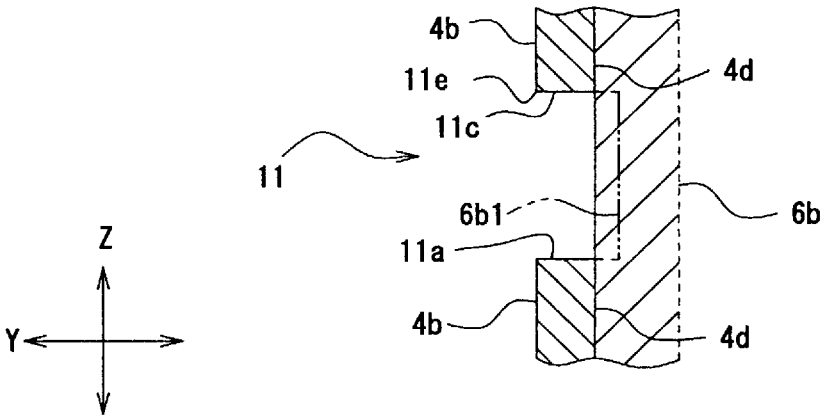

As illustrated in FIG. 7A, however, a through hole 11 may be formed in the contact surface 4*b* instead of the recess 4*c*. Here, among inner walls 11*a* to 11*d* that define the through hole 11, the inner wall 11*a* disposed on a side closer to the socket 3 in the Z direction may be used as a "locking portion" and an opening edge 11*e* of the inner wall 11*c* that opposes the inner wall 11*a* may be used as an "impurity remover". When the through hole 11 is formed in the contact surface 4*b* instead of the recess 4*c*, the front connection portion 5*a* can be inserted into the through hole 11. Since the through hole 11 does not have a back wall 4*c*5 unlike the recess 4*c*, the front connection portion 5*a* can be more deeply inserted into the through hole 11. The deep insertion enables firm locking of the front connection portion 5*a* on the plug terminal 4, whereby a reliable electrical connection between the plug terminal 4 and the socket terminal 5 can be established.

Moreover, the inner wall 11*a* can prevent the front connection portion 5*a* from moving in the direction in which the plug 2 is pulled out even when the plug 2 is moved in that direction since the front connection portion 5*a* is in firm contact with the inner wall 11*a*. Similarly to some embodiments, when the front connection portion 5*a* is deeply inserted into the through hole 11, an operator can receive a stronger tactile "click" response and can manually perceive the progress on the fitting of the socket 3 and the plug 2.

Modified Example of Third Embodiment

FIG. 7B

The third embodiment has described an example in which the plug body 6*b* is not processed. As illustrated in FIG. 7B, however, a recess 6*b*1 may be formed in the plug body 6*b* in accordance with the shape of the through hole 11. This structure enables deeper insertion of the front connection portion 5*a* into the through hole 11 and more securely prevents the plug 2 from being pulled out, whereby a more reliable electrical connection between the plug terminal 4 and the socket terminal 5 can be established. In addition, impurities G can be more deeply pushed toward the plug terminal 4 and thus the impurities G are unlikely to be returned to the contact surface 4*b*. Consequently, the electrical connection between the plug terminal 4 and the socket terminal 5 can be stabilized further.

Fourth Embodiment

Figure 8:
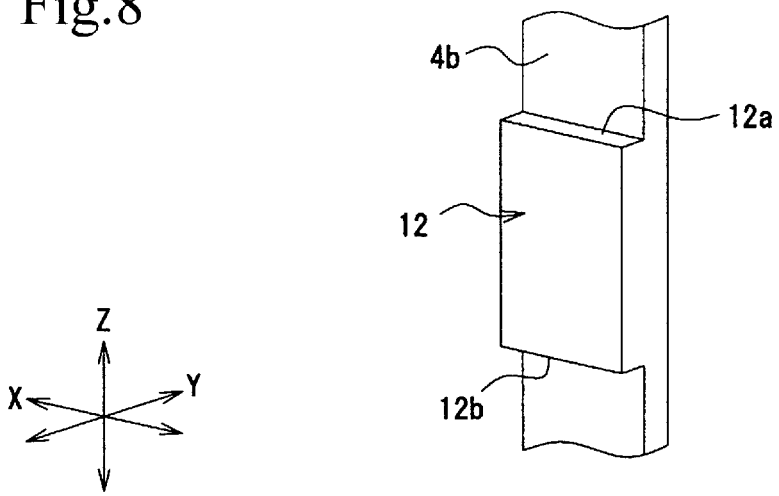
FIGS. 8A and 8B illustrate a protrusion according to a fourth embodiment, where
Figure 8:
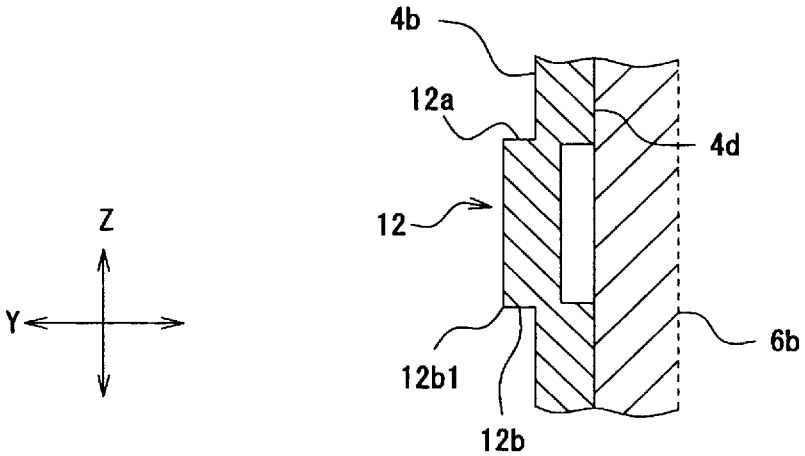

FIGS. 8A and 8B

The third embodiment has described an example in which the through hole 11 is formed in the contact surface 4*b* so as to function as a "locking portion". Examples of the "locking portion", however, include a protrusion 12 that protrudes from the contact surface 4*b* toward the front connection portion 5*a*, as illustrated in FIGS. 8A and 8B.

In this structure, when the plug 2 is to be fitted into the socket 3, each front connection portion 5*a* is caused to cross the protrusion 12 in the direction in which the plug 2 is pulled out. The protrusion 12 has an upper step portion 12*a* on a side closer to the plug 2 in the Z direction, as a "locking portion". Specifically, when the plug 2 is moved in the direction in which the plug 2 is pulled out from the socket 3 while the front connection portion 5*a* is positioned on a side closer to the plug 2 than the upper step portion 12*a*, the front connection portion 5*a* comes into contact with the upper step portion 12*a* and is locked on the upper step portion 12*a*.

The protrusion 12 also has a lower step portion 12*b* on a side closer to the socket 3 in the Z direction. The lower step portion 12*b* has a lower edge 12*b*1, which can function as an "impurity remover". In this structure, impurities G that have adhered to the contact edge 5*a*1 can be scraped off by rubbing the contact edge 5*a*1 against the lower edge 12*b*1 when the front connection portion 5*a* crosses the protrusion 12. In this case, the front connection portion 5*a* that has crossed the protrusion 12 no longer comes into contact with the impurities G that have been scraped off the contact edge 5*a*1 and then adhered to the lower edge 12*b*. Thus, additional adhesion of the impurities G to the front connection portion 5*a* can be prevented.

Furthermore, an operator can receive a tactile click response and can manually perceive the progress on the fitting of the socket 3 and the plug 2 when the front connection portion 5*a* crosses the protrusion 12. Thus, a reliable electrical connection between the plug terminal 4 and the socket terminal 5 can be established.

Fifth Embodiment

Figure 9:
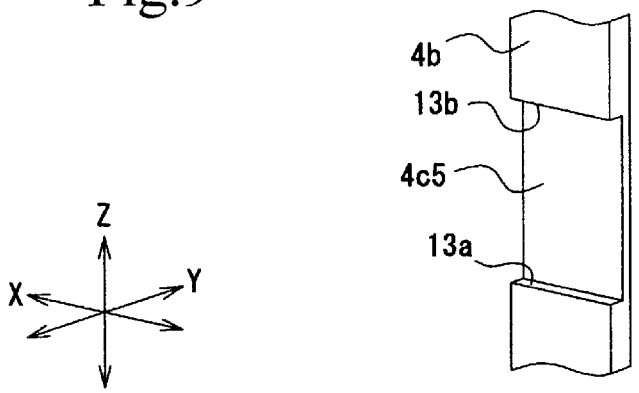
FIGS. 9A and 9B illustrate a recess according to a fifth embodiment, where
Figure 9:
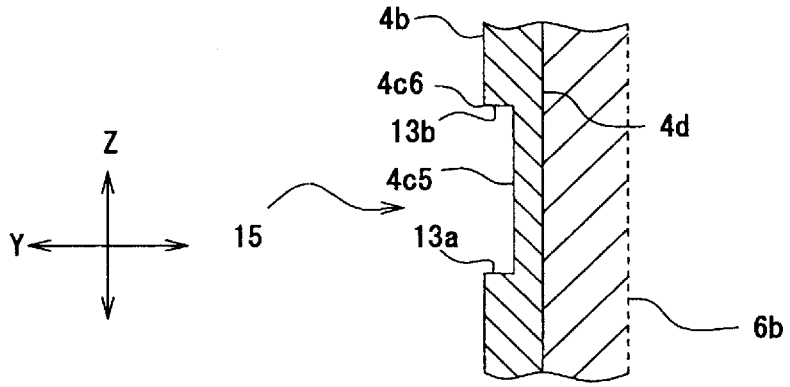

FIGS. 9A and 9B

Some embodiments have described examples in which the recess 4*c*, the through hole 11, or the like includes inner walls parallel to the Z direction. As illustrated in FIGS. 9A and 9B, however, a recess 15 that only includes inner walls 13*a* and 13*b* parallel to the X direction without including inner walls parallel to the Z direction may be provided instead. In this case, the inner walls 13*a* and 13*b* can restrict the movement of the front connection portion 5*a* in terms of only the Z direction. Thus, the floating connector 1 allows a wide range of displacement in the X direction.

Sixth Embodiment

Figure 10:
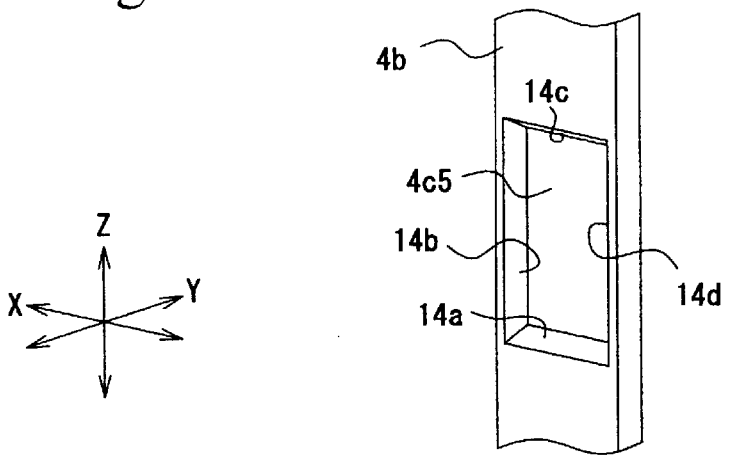
FIGS. 10A and 10B illustrate a recess according to a sixth embodiment, where
Figure 10:
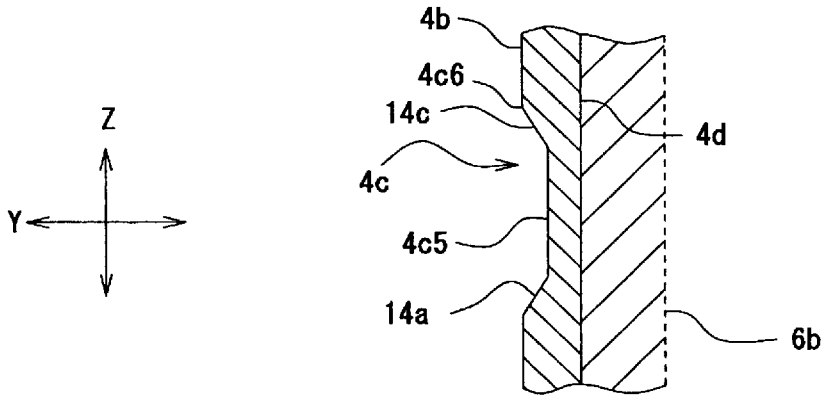

FIGS. 10A and 10B

In some embodiments, the inner walls 4*c*1 to 4*c*4 of each recess 4*c* are formed in the contact surface 4*b* so as to be perpendicular to the surface of the contact portion 4*d*. As illustrated in FIGS. 10A and 10B, however, the inner walls 4*c*1 to 4*c*4 may be replaced by inclined surfaces 14*a* to 14*d* that are inclined so as to be widened from the back wall 4*c*5 toward the opening side.

In the case where each recess 4*c* includes the inclined surfaces 14*a* to 14*d*, the corresponding front connection portion 5*a* is allowed to slide over the inclined surfaces 14*a* to 14*d* and guided to the inside of the recess 4*c* while the plug 2 is being fitted into the socket 3. Specifically, the inclined surfaces 14*a* and 14*c* guide the front connection portion 5*a* to the back wall 4*c*5 in a direction parallel to the Z direction, whereas the inclined surfaces 14*b* and 14*d* guide the front connection portion 5*a* to the back wall 4*c*5 in a direction parallel to the X direction. In the recess 4*c* defined by the inclined surfaces 14*a* to 14*d*, the back wall 4*c*5 has a smaller area than that of a recess 4*c* that has an opening of the same size and that is defined by the inner walls 4*c*1 to 4*c*4. Accordingly, the movable range of the front connection portion 5*a* is smaller, thereby restricting slight sliding movement of the front connection portion 5*a*. This structure thus prevents removable of the plating of the socket terminal 5 and the plug terminal 4 and facilitates a continuous electrical connection between the terminals.

Modified Example of Sixth Embodiment

The sixth embodiment has described an example in which the inner walls 4*c*1 to 4*c*4 of each recess 4*c* are replaced by the inclined surfaces 14*a* to 14*d*. In contrast, the inclined surfaces 14*a* to 14*d* may be provided as, for example, the inner walls of each through hole 11. The inclined surfaces 14*a* to 14*d* in such a structure can have the operations and effects of the through holes 11 according to the third embodiment as well as the guide function according to the sixth embodiment.

Seventh Embodiment

Figure 11:
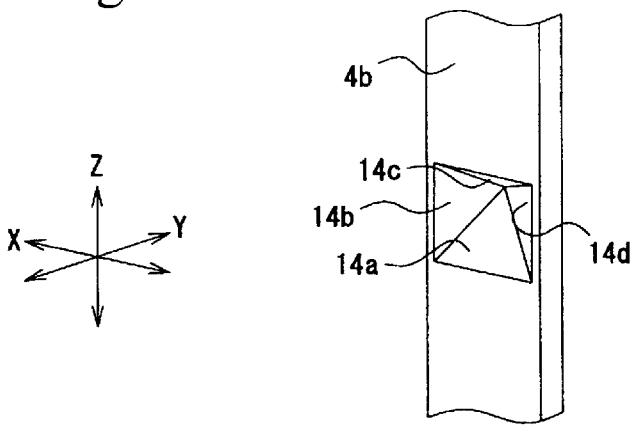
FIGS. 11A and 11B illustrate a recess according to a seventh embodiment, where
Figure 11:
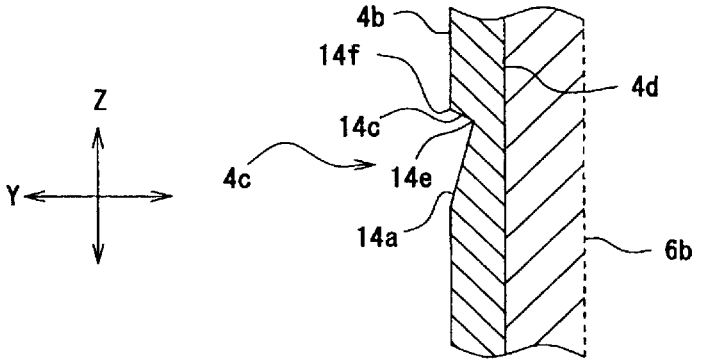

FIGS. 11A and 11B

The sixth embodiment has described an example in which each recess 4*c* has a back wall 4*c*5. As illustrated in FIGS. 11A and 11B, however, a recess 4*c* defined by inclined surfaces 14*a* to 14*d* and having an apex 14*e*, which is the deepest point of the contact portion 4*d*, may be formed instead. In this structure, the inclined surfaces 14*a* and 14*c* can guide the front connection portion 5*a* to the apex 14*e* in the Z direction while the inclined surfaces 14*b* and 14*d* can guide the front connection portion 5*a* to the apex 14*e* in the X direction. The front connection portion 5*a* that has arrived at a portion near the apex 14*e* is restricted by the inclined surfaces 14*a* and 14*c* in terms of the movement in the Z direction and restricted by the inclined surfaces 14*b* and 14*d* in terms of the movement in the X direction. Thus, the front connection portion 5*a* is fixed around the apex 14*e* and slight sliding movement can be restricted. This structure thus prevents removable of the plating of the socket terminal 5 and the plug terminal 4 and can maintain a stable electrical connection between the terminals.

In this case, as illustrated in FIG. 11B, an angle of inclination of the inclined surface 14*c* on the side closer to the plug 2 in the Z direction may be larger than an angle of inclination of the opposing inclined surface 14*a*. This structure allows the contact edge 5*a*1 of each front connection portion 5*a* to easily come into contact with the opening edge 14*f* and facilitates scraping off the impurities G that have adhered to the front connection portion 5*a*.

Eighth Embodiment

Figure 12:
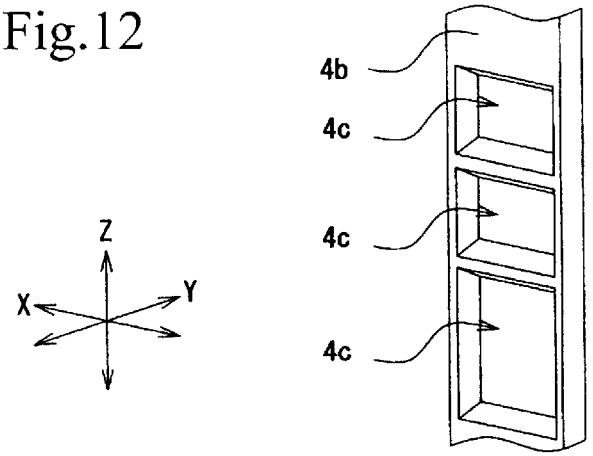
FIGS. 12A and 12B illustrate recesses according to an eighth embodiment, where
Figure 12:
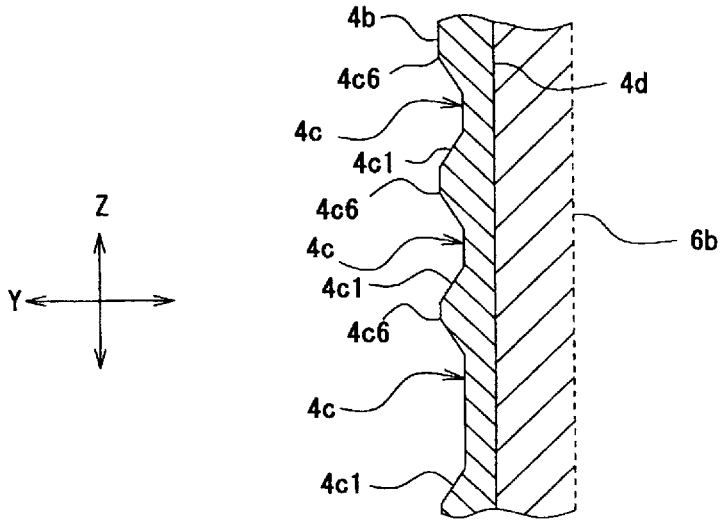

FIGS. 12A and 12B

The above-described embodiments have described examples in which the contact surface 4*b* has one recess 4*c*, one through hole 11, or one protrusion 12, which serves as a "locking portion" or an "impurity remover". However, a plurality of recesses, through holes, or protrusions may be formed in the contact surface 4*b*. For example, FIGS. 12A and 12B illustrate an example in which multiple recesses 4*c* are aligned in the Z direction. Alternatively, a recess 4*c*, a through hole 11, and a protrusion 12 may be provided in combination. Thus, in the example illustrated in FIGS. 12A and 12B, the front connection portion 5*a* comes into contact with the contact edges 5*a*1 multiple times while the plug 2 is inserted into the socket 3, whereby the impurities G can be easily scraped off. On the other hand, in case the front connection portion 5*a* crosses one of the inner walls 4*c*1 as a result of an application of vibrations to the plug 2 in the direction in which the plug 2 is pulled out from the socket 3, the front connection portion 5*a* enters another recess 4*c* on the side closer to the socket 3 in the Z direction and then comes into contact with the inner wall 4*c*1 and is locked on the inner wall 4*c*1. Thus, the socket terminal 5 can be more reliably locked on the plug terminal 4, whereby the electrical connection between the socket terminal 5 and the plug terminal 4 can be reliably maintained.

Other Embodiments

Some of the above-described embodiments have described an example in which one socket terminal 5 includes multiple connection portions (a front connection portion 5*a* and a rear connection portion 5*g*). However, one socket terminal may include one connection portion.

In this case, multiple plug terminals that are arranged may include plug terminals that include a "locking portion" and plug terminals that do not include a "locking portion". In this structure, the socket terminals can be locked on the plug terminals that include a "locking portion". The plug terminals that do not include a "locking portion" function as members to which the socket terminals are electrically connected.

Some embodiments have described the floating connector 1 as an example of an "electric connector" according to the present invention, but other connectors that can electrically connect circuit boards together can serve as the electric connector.

What is claimed is:

1. An electric connector, comprising a plug including a plug terminal and a socket including a socket terminal, the plug terminal and the socket terminal coming into contact with each other and being electrically connected to each other when the plug and the socket are fitted together, wherein the socket terminal includes a connection portion that comes into contact with the plug terminal, wherein the plug terminal includes a locking portion on a contact surface that comes into contact with the connection portion of the socket terminal, the connection portion being locked on the locking portion by coming into contact with the locking portion when moving in a direction in which the plug terminal is pulled out from the socket terminal, wherein the connection portion of the socket terminal includes a front connection portion and a rear connection portion, each of which includes a contact edge formed of an end portion of a flat metal sheet, wherein, while the connector is being changed into a fitted state, the contact edge of the front connection portion wipes away an impurity that adheres to the contact surface by contacting the plug terminal until passing the locking portion from an end-side portion of the plug terminal and, while the connector is in the fitted state, the contact edge is locked on the locking portion as a result of the plug moving relative to the socket in the direction in which the plug terminal is pulled out from the socket terminal, wherein the contact edge of the rear connection portion comes into contact with the plug terminal subsequent to the front connection portion and is electrically connected with the plug terminal at a position between the locking portion and the end-side portion wiped by the contact edge of the front connection portion, and wherein the socket terminal includes a front terminal and a rear terminal, the front terminal including an elastic piece that elastically supports the front connection portion, the rear terminal including an elastic piece that elastically supports the rear connection portion.

2. The electric connector according to claim 1, wherein the socket terminal includes an elastic piece that elastically supports the front connection portion and the rear connection portion.

3. The electric connector according to claim 1, wherein a recess, at which a plate surface of the plug terminal is recessed and into which the contact edge of the front connection portion enters while the plug and the socket are fitted together, is formed in the contact surface of the plug terminal as the locking portion.

4. The electric connector according to claim 1, wherein a through hole, which passes through the thickness of the plug terminal and into which the contact edge of the front connection portion enters while the plug and the socket are fitted together, is formed in the contact surface of the plug terminal as the locking portion.

5. An electric connector, comprising a plug including a plug terminal and a socket including a socket terminal, the plug terminal and the socket terminal coming into contact with each other and being electrically connected to each other when the plug and the socket are fitted together, wherein the socket terminal includes a connection portion that comes into contact with the plug terminal, wherein the plug terminal includes a locking portion on a contact surface that comes into contact with the connection portion of the socket terminal, the connection portion being locked on the locking portion by coming into contact with the locking portion when moving in a direction in which the plug terminal is pulled out from the socket terminal, wherein the connection portion of the socket terminal includes a front connection portion and a rear connection portion, each of which includes a contact edge formed of an end portion of a flat metal sheet, wherein, while the connector is being changed into a fitted state, the contact edge of the front connection portion wipes away an impurity that adheres to the contact surface by contacting the plug terminal until passing the locking portion from an end-side portion of the plug terminal and, while the connector is in the fitted state, the contact edge is locked on the locking portion as a result of the plug moving relative to the socket in the direction in which the plug terminal is pulled out from the socket terminal, wherein the contact edge of the rear connection portion comes into contact with the plug terminal subsequent to the front connection portion and is electrically connected with the plug terminal at a position between the locking portion and the end-side portion wiped by the contact edge of the front connection portion wherein a protrusion, which protrudes from the contact surface of the plug terminal, is disposed on the contact surface of the plug terminal as the locking portion, and wherein the socket terminal and the plug terminal are locked together when the plug terminal moves in the direction in which the plug terminal is pulled out while the plug and the socket are fitted together as a result of the contact edge of the front connection portion crossing the protrusion of the plug terminal.

6. The electric connector according to claim 1, wherein a movable-range gap that allows displacement in directions in which the plug terminal is inserted into and pulled out from the socket terminal while the plug and the socket are fitted together is provided between the contact edge of the front connection portion and the locking portion of the plug terminal so that the plug and the socket are displaceable relative to each other in the directions in which the plug terminal is inserted into and pulled out from the socket terminal while the plug and the socket are fitted together.

7. The electric connector according to claim 1, wherein the contact surface of the plug terminal includes an impurity remover that scrapes the impurity off the contact edge of the socket terminal that has wiped away the impurity as a result of the contact edge sliding over the impurity remover.

8. The electric connector according to claim 1, wherein the contact surface of the plug terminal includes side locking surfaces that restrict sideways displacement of the contact edge of the front connection portion in a width direction of the plug terminal.

9. The electric connector according to claim 1, wherein the contact surface of the plug terminal includes inclined surfaces that position the contact edge of the front connection portion by causing the contact edge to slide over the inclined surfaces in a width direction of the plug terminal.

10. The electric connector according to claim 1, wherein the contact surface of the plug terminal includes inclined surfaces that position the contact edge of the front connection portion by causing the contact edge to slide over the inclined surfaces in at least one of a direction in which the plug terminal is inserted and a direction in which the plug terminal is pulled out.

11. The electric connector according to claim 1, wherein the socket terminal is made of a flat metal sheet having no bent portion in a sheet thickness direction.

12. The electric connector according to claim 1, wherein the socket terminal includes a substrate connection portion that is to be fixed to a circuit board, a movable connection portion including the connection portion, and a movable portion that elastically supports the substrate connection portion and the movable connection portion so that the substrate connection portion and the movable connection portion are displaceable relative to each other.

13. The electric connector according to claim 1, wherein the socket includes a fixed housing that is to be fixed to a circuit board and a movable housing that is to be fitted to a housing of the plug, and wherein the socket terminal includes a movable portion that elastically supports the fixed housing and the movable housing so that the fixed housing and the movable housing are displaceable relative to each other.

14. The electric connector according to claim 5, wherein a movable-range gap that allows displacement in directions in which the plug terminal is inserted into and pulled out from the socket terminal while the plug and the socket are fitted together is provided between the contact edge of the front connection portion and the locking portion of the plug terminal so that the plug and the socket are displaceable relative to each other in the directions in which the plug terminal is inserted into and pulled out from the socket terminal while the plug and the socket are fitted together.

15. The electric connector according to claim 5, wherein the contact surface of the plug terminal includes an impurity remover that scrapes the impurity off the contact edge of the socket terminal that has wiped away the impurity as a result of the contact edge sliding over the impurity remover.

16. The electric connector according to claim 5, wherein the contact surface of the plug terminal includes side locking surfaces that restrict sideways displacement of the contact edge of the front connection portion in a width direction of the plug terminal.

17. The electric connector according to claim 5, wherein the contact surface of the plug terminal includes inclined surfaces that position the contact edge of the front connection portion by causing the contact edge to slide over the inclined surfaces in a width direction of the plug terminal.

18. The electric connector according to claim 5, wherein the contact surface of the plug terminal includes inclined surfaces that position the contact edge of the front connection portion by causing the contact edge to slide over the inclined surfaces in at least one of a direction in which the plug terminal is inserted and a direction in which the plug terminal is pulled out.

19. The electric connector according to claim 5, wherein the socket terminal is made of a flat metal sheet having no bent portion in a sheet thickness direction.

20. The electric connector according to claim 5, wherein the socket terminal includes a substrate connection portion that is to be fixed to a circuit board, a movable connection portion including the connection portion, and a movable portion that elastically supports the substrate connection portion and the movable connection portion so that the substrate connection portion and the movable connection portion are displaceable relative to each other.

21. The electric connector according to claim 5, wherein the socket includes a fixed housing that is to be fixed to a circuit board and a movable housing that is to be fitted to a housing of the plug, and wherein the socket terminal includes a movable portion that elastically supports the fixed housing and the movable housing so that the fixed housing and the movable housing are displaceable relative to each other.

* * * * *